US008503138B2

(12) United States Patent
Demetriades et al.

(10) Patent No.: US 8,503,138 B2
(45) Date of Patent: Aug. 6, 2013

(54) HYBRID CIRCUIT BREAKER

(75) Inventors: Georgios Demetriades, Västerås (SE); Anshuman Shukla, Västerås (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 13/446,601

(22) Filed: Apr. 13, 2012

(65) Prior Publication Data

US 2012/0218676 A1 Aug. 30, 2012

Related U.S. Application Data

(63) Continuation of application No. PCT/EP2009/063317, filed on Oct. 13, 2009.

(51) Int. Cl.
*H01H 9/30* (2006.01)

(52) U.S. Cl.
USPC ..... 361/11

(58) Field of Classification Search
USPC ..... 361/11
See application file for complete search history.

(56) References Cited

U.S. PATENT DOCUMENTS

| | | | | |
|---|---|---|---|---|
| 3,152,282 | A * | 10/1964 | Hartmann et al. | 361/11 |
| 4,550,356 | A * | 10/1985 | Takahashi | 361/9 |
| 4,631,621 | A * | 12/1986 | Howell | 361/13 |
| 4,740,858 | A * | 4/1988 | Yamaguchi et al. | 361/4 |
| 4,862,313 | A * | 8/1989 | Shirouzu et al. | 361/102 |
| 5,164,872 | A * | 11/1992 | Howell | 361/3 |
| 7,508,636 | B2 * | 3/2009 | Sellier et al. | 361/8 |
| 8,138,440 | B2 * | 3/2012 | Onufriyenko et al. | 218/154 |
| 8,358,488 | B2 * | 1/2013 | Premerlani et al. | 361/2 |
| 2005/0146814 | A1 * | 7/2005 | Sellier et al. | 361/8 |
| 2007/0064356 | A1 * | 3/2007 | Wakatsuki et al. | 361/2 |
| 2007/0121257 | A1 * | 5/2007 | Maitra et al. | 361/2 |
| 2012/0218676 | A1 * | 8/2012 | Demetriades et al. | 361/115 |

FOREIGN PATENT DOCUMENTS

| | | | |
|---|---|---|---|
| DE | 102005040432 | A1 | 3/2007 |
| EP | 1538645 | A1 | 6/2005 |

OTHER PUBLICATIONS

International Search Report and Written Opinion of the International Searching Authority; Application No. PCT/EP2009/063317; Issued: May 21, 2010; Mailing Date: Jun. 2, 2010; 9 pages.

* cited by examiner

*Primary Examiner* — Ronald W Leja
(74) *Attorney, Agent, or Firm* — St. Onge Steward Johnston & Reens LLC

(57) ABSTRACT

A hybrid circuit breaker, including a first circuit that includes: a main current path which includes a mechanical switch element, a commutation path arranged in parallel with the main current path and including a controllable semi-conductor switch element. The breaker also includes a first capacitor provided in the commutation path in series with the controllable semi-conductor switch element, and a second circuit, arranged in series with the first circuit and including a second capacitor and an inductance-generating element arranged in series with each other.

9 Claims, 4 Drawing Sheets

HYBRID CIRCUIT BREAKER

CROSS-REFERENCE TO RELATED APPLICATIONS

The present application is a continuation of pending International patent application PCT/EP2009/063317 filed on Oct. 13, 2009 which designates the United States and the content of which is incorporated herein by reference.

FIELD OF THE INVENTION

The present invention relates to a hybrid circuit breaker, comprising a first circuit that comprises: a main current path which comprises a mechanical switch element and at least one commutation path arranged in parallel with the main current path and comprising a controllable semi-conductor switch element.

The invention also relates to an electric power supply system comprising a hybrid circuit breaker according to the invention.

The breaker is an electric current breaker. In particular, it may form part of an AC electric power system. In particular, it may form part of a medium or high voltage electric power system, medium or high voltage being referred to as a voltage of 400 V or above. However, lower voltage applications are not excluded.

The mechanical switch element may comprise any type of mechanical switch comprising first and second contact elements that are movable in relation to each other in connection to the switching operation thereof. Typically, the mechanical switch comprises a mechanical circuit breaker.

The controllable semi-conductor switch element may be any kind of solid-state breaker based on semi-conductor technology and of controllable character such as a controllable thyristor, an IGBT (Insulated Gate Bipolar Transistor), an IGCT (Insulated Gate-Commutated Thyristor) or a GTO, all well known within this field of technology. The expression "controllable" indicates that the element in question opens or closes as soon as an appropriate control is applied to it. Accordingly, in this regard, the controllable semi-conductor element is an active element, or at least not passive.

BACKGROUND OF THE INVENTION

Conventional mechanical circuit breakers have been used for a long time for interruption of fault currents. After having detected a short circuit or an over-load situation, some time (several periods of the electrical line frequency) elapses prior to an opening of the switches mechanically. Subsequently, an arc occurs, which initially has little impact on the current. The current can only be quenched at its natural zero-crossing assuming that the plasma in the region of the contacts of a mechanical circuit breaker is significantly cooled down to avoid re-ignition. As a result, turning off a short circuit will take at least 100 ms (without detection time), i.e., several line periods.

Because of the thermal and electrical stresses inherent in opening and closing of conventional circuit breakers, such breakers have traditionally been very large and expensive devices, requiring expensive maintenance after a number of switching operations. Arcing which occurs across the contacts during interruption of a fault current can damage contact electrodes and restrict nozzles of the mechanical circuit breaker. For this reason conventional circuit breakers require frequent inspection and expensive maintenance. The problem of arcing becomes very acute for breaker applications where high switching frequency is required such as conveyor drives, inching and reverse operations, industrial heaters, test beds etc. The number of high-current short circuit clearances is limited to about 10 to 15 times for contemporary mechanical devices.

The peak current cannot be influenced using these classical mechanical circuit breakers. Therefore, all network components have to withstand the peak current during the switching period. Mechanical circuit breakers also have a maximum short circuit current rating. This current limit forces designers of electric grids to limit the short circuit power of the grids, e.g., by using additional line inductances. However, these measures also reduce the maximum transferable power and the "stiffness" of the grid, leading to an increase of voltage distortions. During the short circuit time, the voltage on the complete grid is significantly reduced. Due to the long turn-off delay of the breaker, sensible loads require UPS support to survive this sag, which is costly and might not be feasible for a complete factory plant.

The latest progresses in power electronics make realistic the replacement of these mechanical type circuit breakers by semiconductors, in order to get very fast systems. Such static circuit breakers based on high power semiconductors potentially offer enormous advantages when compared to conventional solutions, since a solid-state breaker is able to switch in a few microseconds. They also require very little maintenance. Due to the absence of moving parts there is no arcing, contact bounce or erosion. Recently, considerable progress has been made in the development of low power solid-state breakers for AC and DC applications. The main disadvantage of the solid-state breaker is the high thermal losses generated by the continuous load current. Electronic switching devices, such as thyristors, IGBTs and GTOs, always have a voltage drop across their terminals resulting in heating through the $I^2R$ loss. The amount of heat depends on the current. As the current increases, this drawback starts to mount and large heat sink becomes a necessity. At very high currents, the electromechanical breaker remains firmly established, with no short-term likelihood that the solid-state breaker replacing it.

Based on experience, it can be concluded that there are basically three requirements that a circuit breaker must meet. First, during its conducting state, it must conduct large currents with minimal power loss. Second, in the event a fault is detected, it should be capable of transitioning itself to its blocking state without self destructing in the process. Finally, it must then, of course, block any current from flowing despite high potentials on its terminals. Mechanical circuit breakers, by their construction, are ideally suited for the first and last of these requirements, but they could fail in the second requirement, due to large circuit inductance, unless sufficient design tolerances are used. Semiconductor switches, on the other hand, because of their small but still finite on-state resistance, are unsuitable for the first requirement, yet can still perform admirably for the other two. It is a distinct possibility therefore that a parallel combination of semiconductor switch and mechanical breaker might well combine the advantages of both and, at the same time, reduce the requirements that either would need if used alone.

The essential idea of this hybrid breaker, which forms prior art, is to detect the fault through normal means and initiate the opening of the mechanical breaker. After a few hundreds of arc volts have been reached the parallel semiconductor switch can be closed. Current transfers to the semiconductor switch and the mechanical breaker opens fully and clears. The semiconductor switch is then opened by an appropriate signal (or lack of signal) on its control electrode and the current is passed to a third parallel device which constitutes a dissipative network for the inductive fault current, leaving the hybrid breaker system open and clear, blocking the full source potential which may be hundreds of kV. The dielectric and mechanical stresses on the mechanical breaker are much reduced in this system since at no time during its opening process does the mechanical breaker ever see much more than the low voltage needed to trigger the semi-conductor device, nor does it at any time see the full fault current (potentially many kA) arcing on its terminals. This hybrid breaker should therefore allow breakers to be built that are more reliable and have higher power ratings and faster response and re-closure times, and which, in addition, have the capability of multiple operations.

Nevertheless, the use of the conventional AC mechanical breaker in combination with a solid state device is challenging due to:

1. Different reaction times (fault detection, interruption times) required for the two components, i.e. the interruption time $t_{int}$ of the conventional AC mechanical breaker is in the scale of m sec<$t_{int}$<sec meanwhile the interruption time $t_{int}$ of a controllable solid-state device, IGBT, is in the range of μ sec<$t_{int}$<m sec. Current interruption through the solid-state device can be in the range of a couple of microseconds if the stray inductance of the circuit is very low.
2. Different current rating capabilities, i.e. the conventional AC mechanical breaker can interrupt a fault current of some tens of kA but on the other hand controllable solid-state devices, such as IGBTs, can interrupt currents of only some kA.
3. Arc voltage. The fact that the higher the fault current the higher the arc voltage. In order to be able to commutate the current from the mechanical breaker to the solid-state device an arc voltage which is double as high as the solid-state device voltage drop is required.
4. Commutation time. If the loop inductance is high then high commutation time is required. High commutation time results in a further increase in magnitude of the fault current and therefore the solid-state device is forced to interrupt very high currents.
5. Conduction time of the solid-state device is critical due to:
   a. High-conduction time is required in order to completely commutate the current from the mechanical breaker to the solid-state device.
   b. High-conduction time is required when the loop inductance is high
   c. High-conduction time is required in order to extinguish the arc voltage of the mechanical breaker, i.e. no current is flowing through the mechanical breaker.

High-conduction times result in high conduction losses and as a result overheating of the device which can lead into device failures. As a result, conduction time should be kept as low as possible.

Moreover, the hold-off interval may lead to an extremely high turn-off current, in the range of several kA. This high current would require semiconductors with a high peak current turn-off capability or parallel connection of devices. Since the allowable voltage slope is constant, higher grid voltage will consolidate this drawback, because the hold-off interval must be increased. As an example, for a grid voltage of 30 kV it would be 375 microseconds. For low voltage circuit breakers, this hold-off interval setting also takes into account the overloading conditions, resulting in similar high current flowing requirements through the semiconductors.

As mentioned in the previous section, the standard hybrid circuit breaker suffers from the drawback of long hold-off interval. This drawback could be avoided by either preventing the ignition of an arc or limiting the current peak during the hold-off interval. The present invention primarily aims at preventing the ignition of an arc between the contacts of the mechanical switch during breaking action of the latter.

SUMMARY OF THE INVENTION

It is an object of the present invention to present a hybrid circuit breaker which works on the principle of keeping the voltage across a mechanical switch thereof sufficiently low to prevent arcing between the contacts of the mechanical switch in connection to its switching operation.

It is also an object of the present invention to present a hybrid circuit breaker that presents a reduced hold-off interval during breaking and, therefore, results in a reduced turn-off current and less overheating and losses in a static circuit breaker thereof.

The object of the invention is achieved by means of the hybrid circuit breaker comprising a first circuit that comprises a main current path which comprises a mechanical switch element, and at least one commutation path arranged in parallel with the main current path and comprising a controllable semi-conductor switch element, and characterised in that it further comprises a first capacitor provided in said commutation path in series with said controllable semi-conductor switch element, and a second circuit, arranged in series with the first circuit and comprising a second capacitor and an inductance-generating element arranged in series with each other. At line frequency of a power system to which the breaker is connected, the series combination of the second capacitor and the inductance-generating element in the second circuit forms a series resonant circuit, provided that the components thereof are tuned to the line frequency. Therefore, in this state, the impedance offered by this arrangement is almost the same as those of a pure mechanical circuit breaker as the series combination of the second capacitor and the inductance-generating element offers almost zero impedance at line frequency. In the event of a fault, this configuration works on the principle of injecting a counter-voltage. Although the mechanical switch is not able to block the full voltage within the hold-off interval, its blocking capability increases straight proportional with time. This provides the opportunity of allowing constant voltage slope across the breaker during the hold-off interval. In power electronics this is realized by a capacitor, connected in parallel to the semiconductor device. Thus, a capacitor will also be connected in parallel to the mechanical switch. This idea has been implemented in the configuration by using said first capacitor in series with the controllable semiconductor switch.

As mentioned above, in order to achieve almost zero impedance across the second circuit at line frequency the second capacitor and the inductance-generating element of the second circuit are tuned in relation to a line frequency of an electric power system in which the breaker is to be arranged, such that they form a series resonance circuit at said line frequency.

According to a preferred embodiment, for predetermined operation conditions, the mechanical switch element has a predetermined arc voltage, and the capacitance of the first capacitor provided in the commutation path is dimensioned such that the voltage across said first capacitor does not exceed the arc voltage under said predetermined operation conditions. Said predetermined conditions may include the breaker atmosphere (pressure, temperature and type of gas mixture in the region of the contacts of the mechanical switch element). Following a fault occurrence, and when the mechanical switch starts to open, the controllable semi-conductor switch is turned on. This causes the fault current to commutate to the first capacitor via the switched-on semiconductor. To prevent arcing between the contacts, the voltage across the mechanical switch should be kept sufficiently low. To ensure a safe turn-off process the voltage must be beneath the critical voltage slope across the air gap. By suitably designing the first capacitor in the commutation path, the voltage across the first capacitor is not allowed to exceed the arc voltage. The capacitance of the first capacitor in the commutation path can be estimated by the following equation. Cs=ibreaker Δtmech/V arc The inductance-generating element in the second circuit may comprise only the conductor itself, if resulting in a sufficient inductance being achieved during predetermined operation conditions. However, according to a first embodiment, said inductance-generating element is formed by an inductor L. Thereby, a technically uncomplicated and reliable solution is obtained.

According to an alternative embodiment, said inductance-generating element is formed by a transformer, a secondary winding of which is connected in series with a resistive element and a second controllable semiconductor switch. The primary winding of the transformer is connected in series with the second capacitor in the second circuit. Under normal operation conditions when there is no fault, the second controllable semiconductor switch is turned-off and therefore, the inductance of the primary winding of the transformer and the second capacitor form a series resonant circuit at the line frequency. When a fault current is commutated to the first capacitor in the commutation path, the second controllable semi-conductor switch in series with the secondary winding of the transformer is turned on, which results in sufficiently high impedance by forming a detuned circuit with the first capacitor, the second capacitor and the inductance generated by the transformer. This will further reduce the required current rating of the semiconductor and also of the network components connected thereto.

According to yet another embodiment, the second circuit comprises a second inductance-generating element connected in parallel with the series connection of said second capacitor and inductance-generating element. This arrangement results in a parallel resonant circuit being formed by the second capacitor and the second inductance-generating element, which in combination with the capacitance of the first capacitor provided in the commutation path offers extremely high impedance to the fault current. This will cause further reduction in the fault current flowing through the semiconductors, thereby reducing heating of and losses in the latter. Preferably, the second inductance-generating element comprises an inductor. This solution is particularly preferable in those cases when the first inductance-generating element comprises the above-mentioned transformer with its associated resistive element and the second semiconductor switch element.

According to yet another embodiment of the invention, the first circuit of the hybrid circuit breaker of the invention comprises a dissipative circuit arranged in parallel with said commutation path. The dissipative circuit is also arranged in parallel with the main current path. The dissipative circuit may be any kind of circuit or system capable of dissipating energy upon breaking action of the controllable semi-conductor switch in connection to the current breaking activity of the breaker. Typically such a system may include a voltage-dependant resistance such as a varistor or the like. It may, as an alternative comprise a so called snubber circuit. However, in cases in which the current is low or very low, the dissipative circuit may be omitted.

Further features and advantages of the present invention will be presented in the following detailed description of preferred embodiments and in the annexed patent claims.

BRIEF DESCRIPTION OF THE DRAWINGS

Embodiments of the present invention will now be described more in detail with reference to the enclosed drawings, in which.

DETAILED DESCRIPTION OF THE INVENTION

Figure 1A:
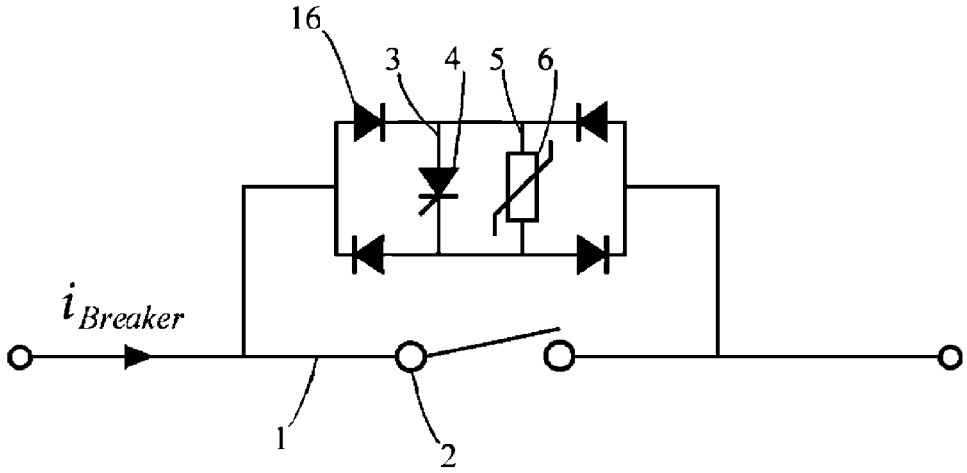
Fig. 1a Prior art
FIGS. 1*a* and 1*b* show diagrams of current hybrid circuit breakers according to prior art.
Figure 1B:
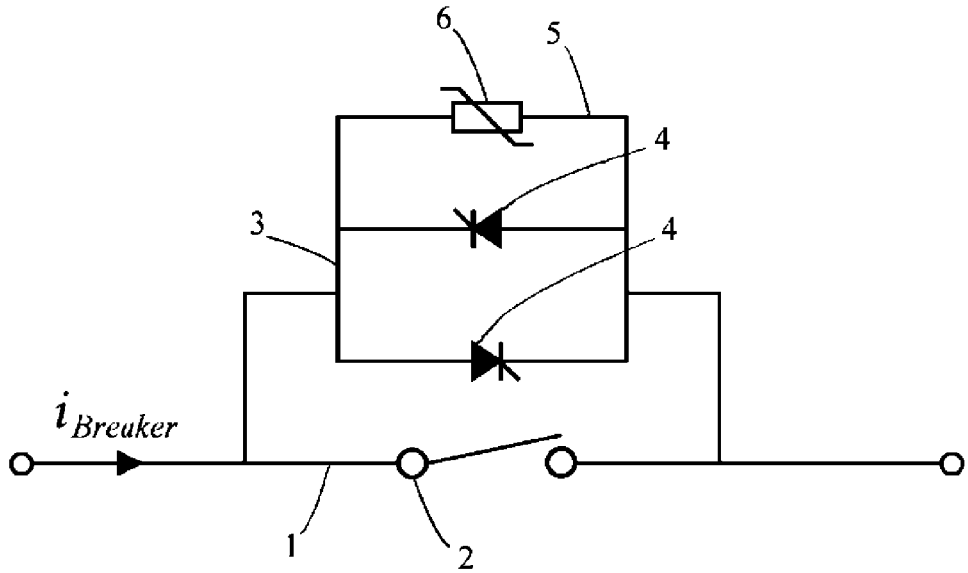
Fig. 1b Prior art

FIGS. 1*a* and 1*b* show two embodiments of hybrid circuit breakers of prior art, said embodiments also forming two examples of a main part of a first circuit of a circuit breaker according to the present invention, as will be seen later. In FIGS. 1*a* and 1*b* there are presented two different configurations of a bidirectional hybrid circuit breaker. In both embodiments, there is provided a main current path 1 with a mechanical switch element 2, a commutation path 3 parallel to the main path and comprising a controllable semiconductor switch element 4, as well as a dissipative circuit 5 arranged in parallel with the main path 1 and the commutation path 3 and provided with a suitable dissipative element 6, such as a varistor or the like. It is evident from these figures that a bidirectional ability of the circuit can be either achieved by a single controllable semiconductor switch element 4 along with four diodes 16 arranged in a bridge as known per se and as shown in FIG. 1*a*, or by two controllable semiconductor switch elements 4 alone, as shown in FIG. 1*b*. It is to be noted that, depending on device ratings, each semiconductor element 4 shown in FIGS. 1*a* and 1*b*, may be a set of or series or parallel combination of similar semiconductor devices, which, as a whole, work as a single element or device. The controllable switch elements 4 can be controllable thyristors, GTOs, IGBTs or IGCTs, etc.

Figure 2:
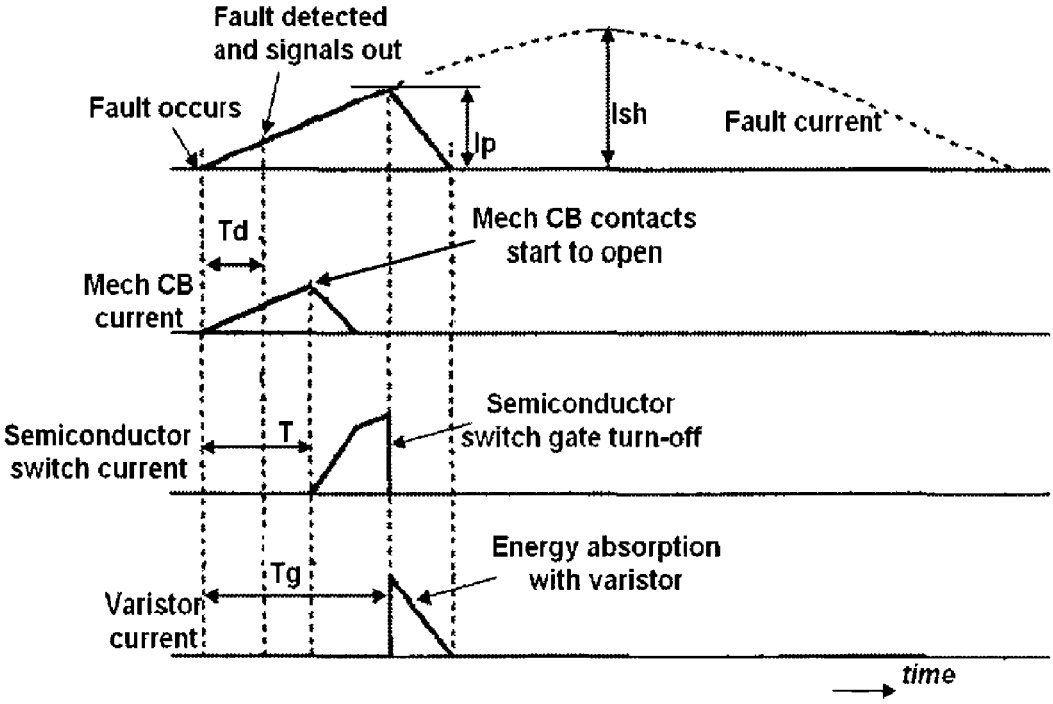
FIG. 2 is a diagram showing the main operating principles of a breaker according to FIG. 1.

The operation of a hybrid circuit breaker like any one of those shown in FIGS. 1*a* and 1*b* is described with reference also to FIG. 2. In FIG. 2 Ip is the maximum value of the fault current flowing through the network with the breakers of FIGS. 1*a* and 1*b*, Ish is the peak value of the fault current when the breaker of FIGS. 1*a* and 1*b* is in operation, Td is the time delay between the instant of fault occurrence and the instant of fault detection, T is the time gap between the instant of fault occurrence and when the semiconductor element 4 starts to conduct, Tg is the time gap between the instant of fault occurrence and when the dissipative element 6 starts to absorb the energy, and Tv is the time interval during which the dissipative element 6 in FIGS. 1*a* and 1*b* absorbs the energy. During normal operation, when a current is conducted through the main path 1, only the mechanical switch element 2 of the circuit breaker is actually closed, thereby conducting the whole current. The semiconductor switch element or elements 4 is/are in an open, i.e. non-conducting, state in order to avoid losses and heating thereof due to the inherent resistance thereof. When any kind of fault is detected, and the current through the breaker is to be turned off, i.e. breaking is to be performed, the semiconductor elements 4 have to be activated first, offering a parallel branch for the current commutation process, i.e. opening the commutation path 3 for conduction of the current through the latter. Next the mechanical switch element 2 is opened, leading to an arc voltage which is responsible for the commutation of the current to the commutation path 3. Since the air gap between contacts (not shown here) of the mechanical switch element 4 is not able to block the full voltage, the semiconductor elements 4 must carry the current for a certain amount of time, resulting in an unhampered current slope. Once this holding interval is elapsed the semiconductor elements 4 are turned off, i.e. they are once again brought to their non-conducting state. Following the turning off of the semiconductor elements 4, the stored energy in the loop inductance is absorbed by the dissipative element (or overvoltage protection element) 6 in the dissipative circuit 5.

Figure 3:
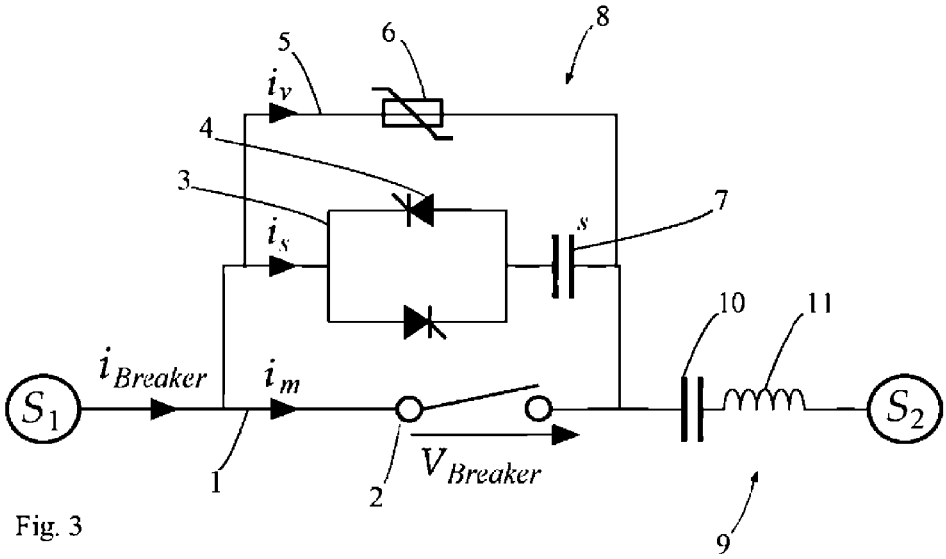
FIG. 3 shows a first embodiment of a hybrid circuit breaker according to the present invention.

Now referring to FIG. 3, a first embodiment of a current hybrid circuit breaker according to the present invention will be described more in detail. Likewise to the hybrid circuit breakers of prior art, the circuit breaker of the present invention comprises a main current path 1 with a mechanical switch element 2, a commutation path 3 parallel to the main path and comprising a controllable semiconductor switch element 4, as well as a dissipative circuit 5 arranged in parallel with the main path 1 and the commutation path 3 and provided with a suitable dissipative element 6, such as a varistor or the like. Preferably, the mechanical switch element 2 is a mechanical circuit breaker, while the controllable semiconductor element may be any one of or a combination of a controllable thyristor, an IGBT, an IGCT or a GTO or any similar device. Preferably, the circuit breaker is arranged in a medium or high voltage power distribution network or between different networks. In FIG. 3 (likewise to the embodiments of FIGS. 4 and 5), S1 and S2 indicate two points in such a network or junctions between such networks, the circuit breaker being arranged between and electrically connecting said points or junctions S1, S2. The network or networks are AC networks presenting a predetermined line frequency.

In addition to the above-mentioned components shared by the circuit breaker of the invention and circuit breakers of prior art, the present circuit breaker also presents a first capacitor 7 provided in the commutation path 3 in series with the controllable semiconductor element 4 thereof. Together with the already mentioned components, this capacitor forms part of a first circuit 8 of the circuit breaker of the invention.

Moreover, the circuit breaker of the present invention also comprises a second circuit 9 provided in series with the first circuit 8. The second circuit 9 comprises a second capacitor 10 and an inductance-generating element 11 arranged in series with each other. In the embodiment shown in FIG. 3, the inductance-generating element 11 comprises an inductor. The second capacitor 10 and the inductor 11 are tuned with regard to the line frequency of the network in which the circuit breaker is arranged, such that they form a perfect resonant circuit at said line frequency during normal operation when the current is conducted only through the main current path 1 of the circuit breaker of the invention. Thereby, almost zero impedance is generated by the combination of said second capacitor 10 and inductor 11 during normal operation conditions when the circuit breaker is inactivated.

Following a fault occurrence on either side of the circuit breaker, or when the mechanical switch element 2 starts to open, the corresponding one of the two controllable semiconductor elements 4 is turned on, i.e. opened for conduction of current through it. This causes the fault current to commutate to the commutation path 3 and to the first capacitor 7 via the switched-on semiconductor element 4. To prevent arcing between the contacts, the voltage across the mechanical switch element 2 should be kept sufficiently low. To ensure a safe turn-off process the voltage must be beneath the critical voltage slope across the air gap. By suitably designing the first capacitor 7, the voltage across said first capacitor 7 is not allowed to exceed the arc voltage Varc. When the fault current flows through the first capacitor and through the series combination of the inductor 11 and the second capacitor 10, the resulting LC circuit between S1 and S2 is no longer in series resonance. This is because the equivalent capacitance of this circuit is now the series combination of the first capacitor 7 and the second capacitor 10. This specific provision of the capacitors 7, 10 results in high impedance against the fault current that flows through the semiconductor elements 4. Depending on the resultant inductance and capacitance value, the fault current can be limited by a significant factor. The fault current will be additionally limited by the fact that the first capacitor has now charged to a voltage following the arc is extinguished. This voltage acts as a countervoltage and limits the fault current as well. Therefore, as opposed to that in the conventional cases detailed in the previous section, with reference to FIGS. 1 and 2, the semiconductor switch elements 4 in FIG. 3 are not required to be of very high current rating. The varistor 6 or the like in FIG. 3 has the same function as the one described earlier with reference to FIG. 1.

Figure 4:
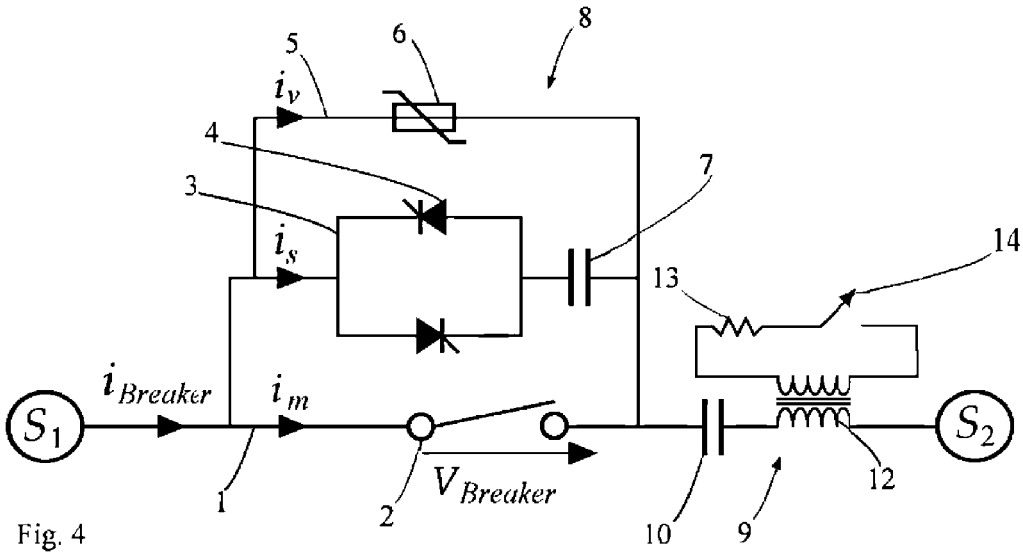
FIG. 4 shows a second embodiment of a hybrid circuit breaker according to the present invention.

A second embodiment of a hybrid circuit breaker of the present invention is presented in FIG. 4. In this embodiment, the inductance-generating element comprises a transformer 12. The primary winding of the transformer 12 is connected in series with the second capacitor 10. The secondary winding of this transformer is connected in series with a resistive element 13, preferably formed by a resistor, and a second controllable semiconductor switch element 14. Under normal operating conditions when there is no fault, the second controllable semiconductor switch element 14 is turned-off (in a non-conducting state) and therefore, the primary winding inductance of the transformer 12 and the second capacitor form a series resonant circuit at the line frequency in the same way as discussed above with reference to the first embodiment. When, upon detection of a fault, the fault current is commutated to the commutation path and, thereby, to the first capacitor 7 located therein, the second controllable semiconductor switch element is turned on, which results in sufficiently high impedance by forming a detuned circuit with the first and second capacitors 7, 10 and the transformer 12. This will further reduce the required current rating of the semiconductor and also of any network component connected thereto.

If the resistance value of the resistive element 13 in FIG. 4 is taken too small, for example, if it is just considered as the on-state resistance of the second controllable semiconductor switch element 14, the resulting impedance offered by the transformer arrangement during the time interval of the on-state of the second semiconductor switch element 14 will be negligible. In that case, the fault current will be limited by the impedance offered by the series connection of the first and second capacitors 7, 10. Similarly, for a suitably high value of said resistance of the resistive element 13, the fault current limitation extent will be different. Therefore, depending on the current limiting requirement and taking into consideration the realistic sizes of various passive components, a suitable configuration may be chosen.

Figure 5:
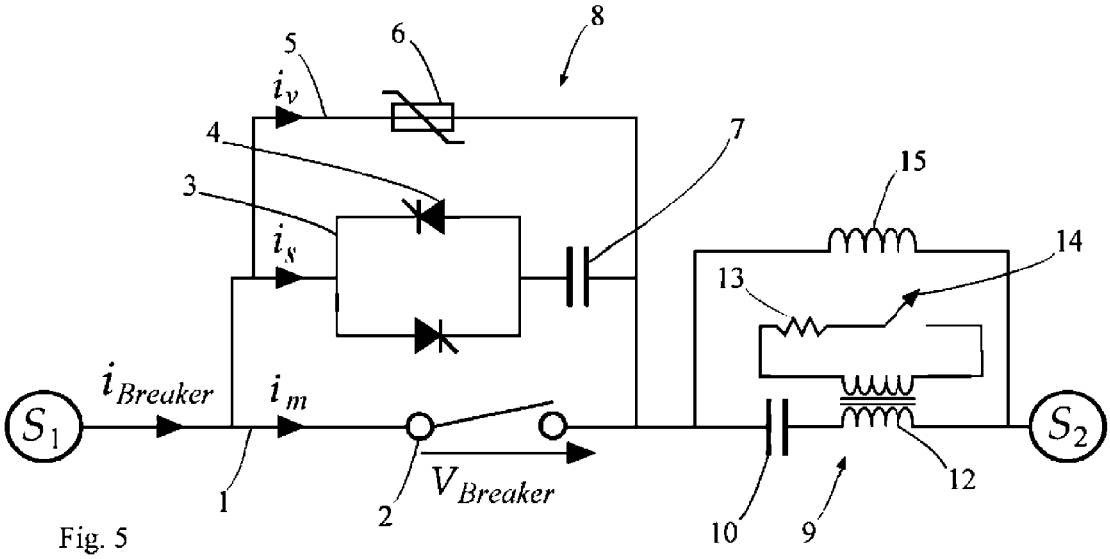
FIG. 5 shows a third embodiment of a hybrid circuit breaker according to the present invention.

In FIG. 5, another embodiment, based on the similar concepts as detailed earlier with reference to FIGS. 3 and 4, is shown. This embodiment differs from the one shown in FIG. 4 in that the second circuit 9 comprises a second inductance-generating element 15 arranged in parallel with the series connection of the second capacitor 10 and the transformer 12. Preferably, the second inductance, as is the case in the present embodiment, comprises and inductor. However, other solutions are also conceivable. In the case when there is no fault, the line current flows through the mechanical contacts and series resonant circuit of the second capacitor 10 and the transformer 12 provided that the second controllable semiconductor switch element 14 is turned off. The resistance of the resistive element 13 in this case is sufficiently small so that when the second controllable semiconductor switch element 14 is turned on in the event of a fault, the resulting impedance offered by transformer 12 to the fault current becomes almost negligible. This results in a parallel resonant circuit of the second capacitor 10 and the second inductance-generating element 15, which in combination with the first capacitor 7 offers extremely high impedance to the fault current. This will cause further reduction in the fault current flowing through the first controllable semiconductor switch element 4, as compared to the other embodiments.

Figure 6:
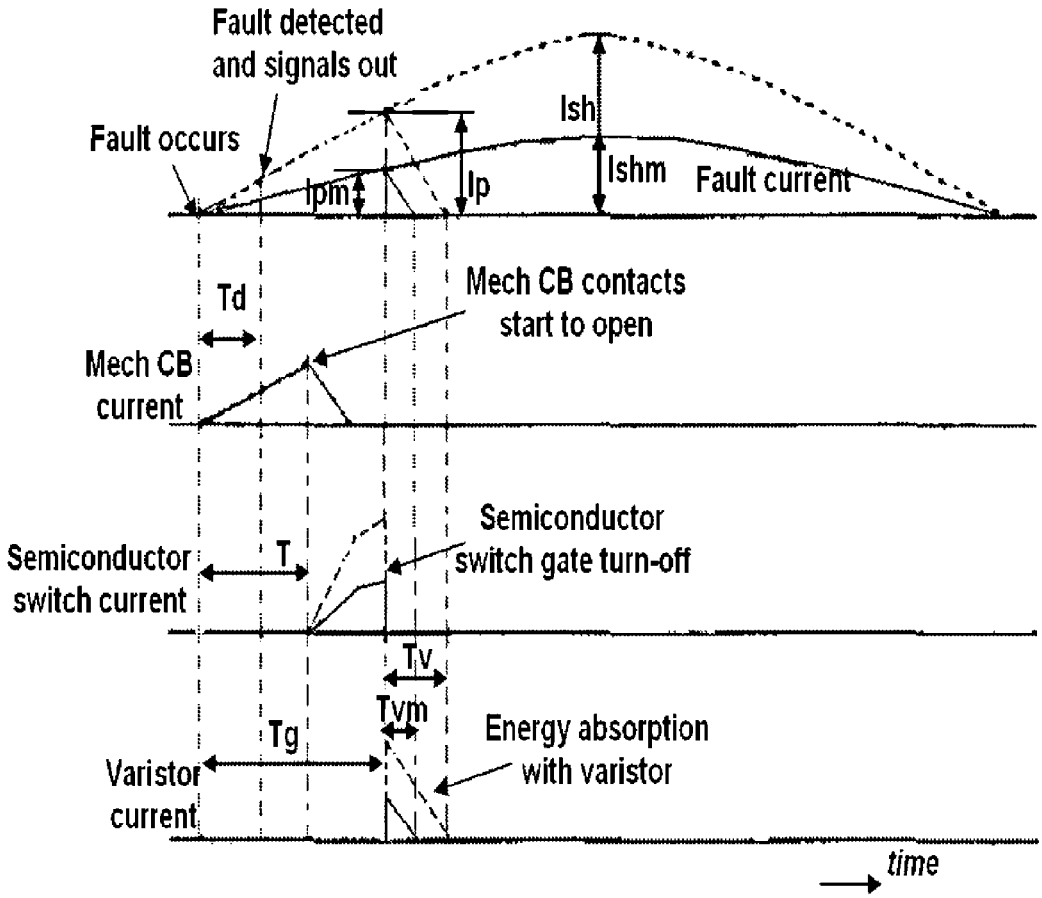
FIG. 6 is a diagram showing the main operating principles of a circuit breaker according to the present invention, with the operating principles according to FIG. 2 indicated with dotted lines in the figure for comparative purposes.

In FIG. 6, different waveforms of the electric current passing through the hybrid circuit breaker according to the invention are illustrated, where the full opening sequence of the circuit breaker has been shown. With reference to FIGS. 3-5, $i_m$ represents the current passing through the mechanical breaker 2, $i_s$ represents the current passing through the semiconductor switch element 4, and $i_v$ represents the current passing through the dissipative circuit 5 and its dissipative element/varistor 6. Mech. CB stands for mechanical current breaker. In FIG. 6, the dotted waveforms represent the electric currents that would be obtained while using the conventional hybrid circuit like that of FIG. 1 and are same as depicted earlier in FIG. 2. In addition to those symbols that are identical with the ones already described for and shown in FIG. 2, FIG. 6 also presents the following symbols: Ipm is the maximum value of the fault current flowing through the network with one of the breakers of FIGS. 3, 4 and 5, Ishm is the peak value of the fault current when breaker of FIG. 3 or 4 or 5 is in operation, T is the time gap between the instant of fault occurrence and when one of the semiconductors (depending on the fault location), as in FIGS. 1, 3, 4 and 5, starts to conduct, and Tvm is the time interval during which the dissipative element/varistor 6, in FIG. 3 or 4 or 5, absorbs the energy. The solid waveforms in FIG. 6 correspond to the electric currents while using one of the current limiting hybrid circuit breakers of FIGS. 3, 4 and 5. Due to the current-limiting device, the fault current magnitude is reduced from Ish to Ishm (see FIG. 6). Therefore, the semiconductors of the circuit breaker according to the present invention need to carry an electric current of reduced magnitude. Under normal condition, when there is no fault, the line current flows through the mechanical contacts and series resonant circuit formed by the second capacitor 10 and the first inductance-generating element 10, 12. When the fault occurs and until the time when the mechanical contacts of the mechanical switch element 2 start to separate, the fault current magnitude follows the original fault current waveform (with peak Ish), as the current-limiting circuit is not in action. It is to be noted that this case is specific to the configuration of FIG. 3. If one of the configurations of FIGS. 4 and 5 is used, the current-limiting effect can be implemented as soon as the fault is detected by turning on the second controllable semiconductor switch element 14. In that case, the mechanical contacts of the mechanical switch element 2 will also carry reduced fault current until the time when its contacts are safely locked to an open position and the arc, if any, is completely extinguished. Following the time when the mechanical contacts start to open, the fault current commutates to the parallel commutation circuit with the first capacitor 7, and the first controllable semiconductor switch element 4 is turned on, if it was not turned on earlier, to result in reduced magnitude current. Once the holding interval is elapsed the controllable semiconductors switch elements 4, 15 are turned off. Following the turning off of the semiconductor switch elements 4, 15, the stored energy in the loop inductance is absorbed by the dissipative circuit 5 with its overvoltage protection element 6, such as a varistor, as shown in FIGS. 3-5. It is to be noted that the varistors 6 needed for the circuit breaker configuration is of lower current rating compared to prior art solutions as the current through the first semiconductor switch element 4 is of lower value compared to that in the case of conventional hybrid circuit breaker of FIG. 1. This is also depicted in FIG. 6 where the varistor is shown to withstand lower magnitude of current for a shorter duration as well.

Advantages of the configurations can be summarized as:

1. Arc-less interruption
2. Required fault current handling capability of the mechanical contacts can be reduced.
3. Turn-on at lower fault current compared with the conventional hybrid breaker
4. Lower turn-off current.
5. The solid-state device must handle (dissipate) comparably lower energy.
6. Compact solution, the solid-state device is not as bulky as in the case of the conventional hybrid breaker.
7. Lower temperature rise in the solid-state device due to lower peak current.
8. Current limiting ability
9. Can be used in both AC and DC current interruptions.
10. Lower varistor rating is required.
11. Overall turn-off process completes earlier.
12. Comparably lower commutation time possible.
13. Possible reduction of the conduction time of the solid-state breaker.
14. The connected network components don't need to be rated with respect to short-time very high fault current-handling capability.

What is claimed is:

1. A hybrid circuit breaker, comprising a first circuit that comprises:

a main current path which comprises a mechanical switch element, and at least one commutation path arranged in parallel with the main current path and comprising a controllable semiconductor switch element, and characterised in that it further comprises a first capacitor provided in said commutation path in series with said controllable semi-conductor switch element, and a second circuit, arranged in series with the first circuit and comprising a second capacitor and an inductance-generating element arranged in series with each other.

2. The hybrid circuit breaker according to claim 1, characterised in that the second capacitor and the inductance-generating element of the second circuit are tuned in relation to a line frequency of an electric power system in which the breaker is to be arranged, such that they form a series resonance circuit at said line frequency.

3. The hybrid circuit breaker according to claim 1, characterised in that, for predetermined operation conditions, the mechanical switch element has a predetermined arc voltage, and the capacitance of the first capacitor provided in the commutation path is dimensioned such that the voltage across said first capacitor does not exceed the arc voltage under said predetermined operation conditions.

4. The hybrid circuit breaker according to claim 1, characterised in that said inductance-generating element is formed by an inductor.

5. The hybrid circuit breaker according to claim 1, characterised in that said inductance-generating element is formed by a transformer, a secondary of which is connected in series with a resistive element and a second controllable semiconductor switch.

6. The hybrid circuit breaker according to claim 1, characterised in that the second circuit comprises a second inductance-generating element connected in parallel with the series connection of said second capacitor and inductance-generating element.

7. The hybrid circuit breaker according to claim 1, characterised in that the hybrid circuit breaker of the invention comprises a dissipative circuit arranged in parallel with said commutation path.

8. An electric power supply system, characterised in that it comprises a hybrid circuit breaker comprising a first circuit that comprises:

a main current path which comprises a mechanical switch element, and at least one commutation path arranged in parallel with the main current path and comprising a controllable semi-conductor switch element, and characterised in that it further comprises a first capacitor provided in said commutation path in series with said controllable semi-conductor switch element, and a second circuit, arranged in series with the first circuit and comprising a second capacitor and an inductance-generating element arranged in series with each other.

9. The electric power supply system according to claim 8, characterised in that it is an AC system.

* * * * *